US006270132B1

(12) United States Patent
Kretschmer

(10) Patent No.: US 6,270,132 B1
(45) Date of Patent: Aug. 7, 2001

(54) CORN COB HOLDING DEVICE

(76) Inventor: Nicholas A. Kretschmer, 11061 W. Cobb Ave., Hales Corners, WI (US) 53130

( * ) Notice: Subject to any disclaimer, the term of this patent is extended or adjusted under 35 U.S.C. 154(b) by 0 days.

(21) Appl. No.: 09/557,727

(22) Filed: Apr. 26, 2000

(51) Int. Cl.[7] ..... A47G 21/00
(52) U.S. Cl. ..... 294/5
(58) Field of Search ..... 294/5, 8, 55.5, 294/61, 1.1; 30/322–324; 99/393–395, 419, 421 R, 421 A; 426/134; 446/236, 265, 266, 297, 386, 397, 404, 491; D7/683

(56) References Cited

U.S. PATENT DOCUMENTS 1,539,669 * 5/1925 Hauser ..... 294/5
2,465,626 * 3/1949 Barrett ..... 294/5
2,827,848 * 3/1958 Alden ..... 99/421 R
3,387,555 * 6/1968 Moran ..... 99/421 R
3,589,009 * 6/1971 Miscavich et al. ..... 30/322
3,805,384 * 4/1974 Falcone ..... 294/5 X
3,995,902 * 12/1976 Sciaino ..... 294/5
5,062,211 * 11/1991 Di Amico ..... 30/322
5,075,970 * 12/1991 Albert ..... 30/322 X
5,088,782 2/1992 Scott .
5,209,692 * 5/1993 Coleman et al. ..... 426/134 X
6,012,749 1/2000 Farber et al. .
6,062,936 * 5/2000 Rudell et al. ..... 446/81 X

* cited by examiner

*Primary Examiner*—Johnny D Cherry
(74) *Attorney, Agent, or Firm*—Joseph S. Heino

(57) ABSTRACT

A pair of handle grip-like holders are intended to be used in tandem in opposing ends of a cob of corn. The holders have removable skewer members, each of which is insertable into the ends of a corn cob. A first holder member is insertable within a first end of the cob of corn. This first holder member is adapted to allow rotation of the cob about the holder. The second holder member includes a torsion member having a pair of spikes which are insertable within the other end of the corn cob and about which the corn cob can rotate when the handle member is actuated by means of an actuating button. The corn cob holder member which is rotatable can be controllable both as to speed and amount of rotation. The handle end about which the corn cob rotates includes an electrically actuable sound generating device which, in the preferred embodiment, simulates the noise of a motorcycle engine.

17 Claims, 2 Drawing Sheets

10
11
12
13
14
15
17
18
19
21
22
23
24
25
26
27
28
29
6
L
R
C

FIG. 4
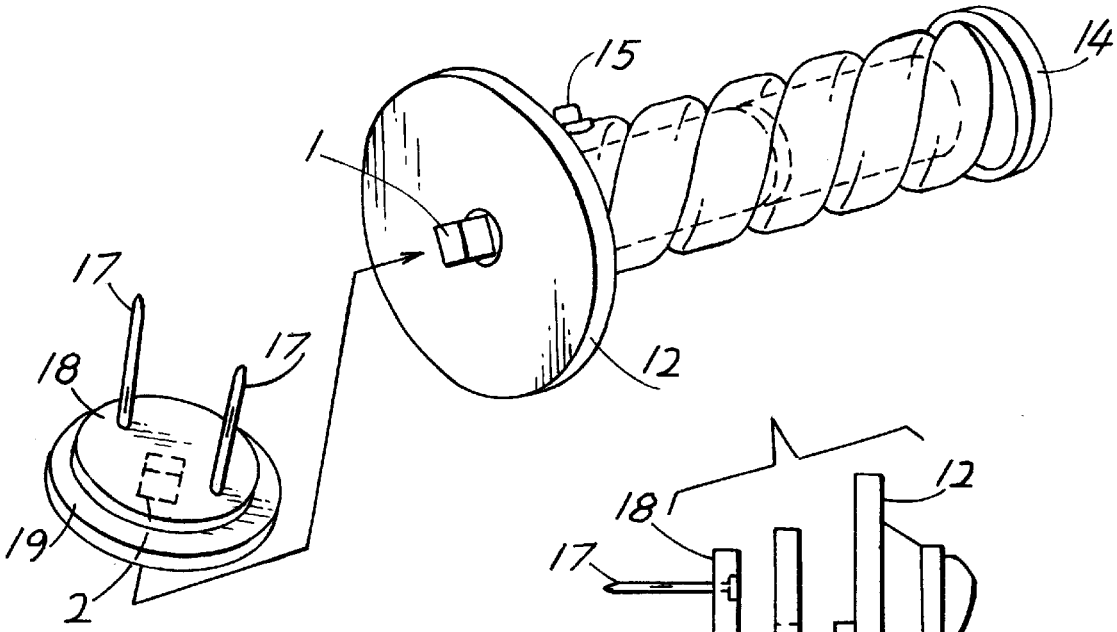
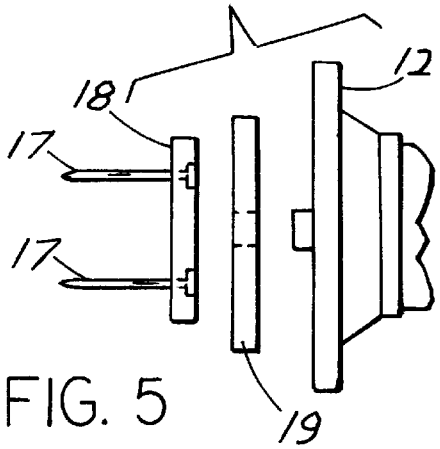
FIG. 5
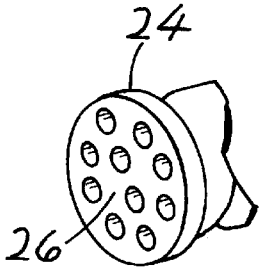
FIG. 6

CORN COB HOLDING DEVICE

FIELD OF THE INVENTION

This invention relates to eating utensils and the like. More particularly, it relates to a corn cob holding device which is electrically actuable to rotate a cob of corn without the need to manually do so. It also relates to such a corn cob holding device which provides a novelty sound generating means contained within the holding device.

BACKGROUND OF THE INVENTION

The human animal is an omnivorous one. Meat, fruits and vegetables all provide major food sources for most people the world over. Among those vegetables most revered is the humble cob of corn. Unlike many vegetables which are enjoyed when served either hot or cold, the cob of corn seems to be best eaten when it is served piping hot. It is also a vegetable which seems to be best eaten when served with melted butter and a sprinkling of salt. All of this makes holding and eating the venerable favorite of the summer picnic a rather tricky and messy affair. The device of the present invention is one which was designed to deal with this situation.

And for those small persons who have ever heard the admonishment of "eat your vegetables," all sorts of tricks and gimmicks have been devised to entice little ones to do just that. From using toy shaped plates and utensils to encourage youngsters to clean their plates, adults have come up with all sorts of solutions to picky eaters. The device of the present invention is also one which fits within this category.

SUMMARY OF THE INVENTION

In order to confidently eat a cob of corn without the aid of any special eating utensil or device, one must allow the corn cob to cool sufficiently to allow firm handling of it. This, however, still does not avoid the problem of mess. In an attempt to avoid butter and salt covered fingers, man has devised corn cob skewers which, in their simplest form, may consist of nothing more than a pair of sticks which are stuck into each end of the corn cob. More sophisticated skewers have been devised which consist of a pair of wooden or plastic holders each having a pair of metal spikes protruding from one end of each holder and which likewise stick into the cob ends, again from opposite sides. Yet another configuration utilizes a pair of plastic holders each of which has an integrally formed screw which is rotated and twisted into the opposing corn cob ends.

While each of these cob holders is acceptable in allowing handling of the corn cob and avoiding some of the mess associated with that, the short coming of each is that the corn cob must still be manually rotated to allow the user to eat each row of corn as the cob is consumed. Furthermore, these cob holders do nothing to entice a picky eater to find corn as something which is fun to eat.

Accordingly, it is an object of this invention to provide a new, useful and uncomplicated corn cob holder which is easily used by youngsters of all ages. It is yet another object of this invention to provide such a corn cob holder which is electrically actuable so as to allow rotation of the corn cob without the need to manually do so. It is still another object of the device of the present invention to provide such corn cob holder which is easily cleanable and reusable. It is yet another object of the device of the present invention to provide a sound generating mechanism within the device. It is still another object of the device of the present invention to provide such a corn cob holder which is fun to use.

The present invention has obtained these objects. It provides for a pair of handle grip-like holders which are intended to be used in tandem in opposing ends of a cob of corn. The holders have removable skewer members, each of which is insertable into the ends of a corn cob. A first holder member is insertable within a first end of the cob of corn. This first holder member is adapted to allow rotation of the cob about the holder. The second holder member includes a torsion member having a pair of spikes which are insertable within the other end of the corn cob and about which the corn cob can rotate when the handle member is actuated by means of an actuating button. The corn cob holder member which is rotatable is controllable both as to speed and amount of rotation. This allows for rotation of the corn cob as such is desired or required and incrementally so as to allow for eating of consecutive rows of corn as the corn cob is advanced for that purpose. The handle end about which the corn cob rotates includes an electrically actuable sound generating device which, in the preferred embodiment, simulates the noise of a motorcycle engine. The foregoing and other features of the device of the present invention will be further apparent from the detailed description which follows.

BRIEF DESCRIPTION OF THE DRAWINGS

FIG. 4 is a front and left side perspective view of a first handle member of the holding device shown in FIG. 3 and showing the skewering portion thereof as detached from the first handle member.

FIG. 5 is a further enlarged and exploded front elevational view of the skewering portion of the first handle member shown in FIG. 4.

FIG. 6 is a left and front perspective view of the end of the second handle member of the holding device shown in FIG. 3.

DETAILED DESCRIPTION

Figures 1, 2, 3:
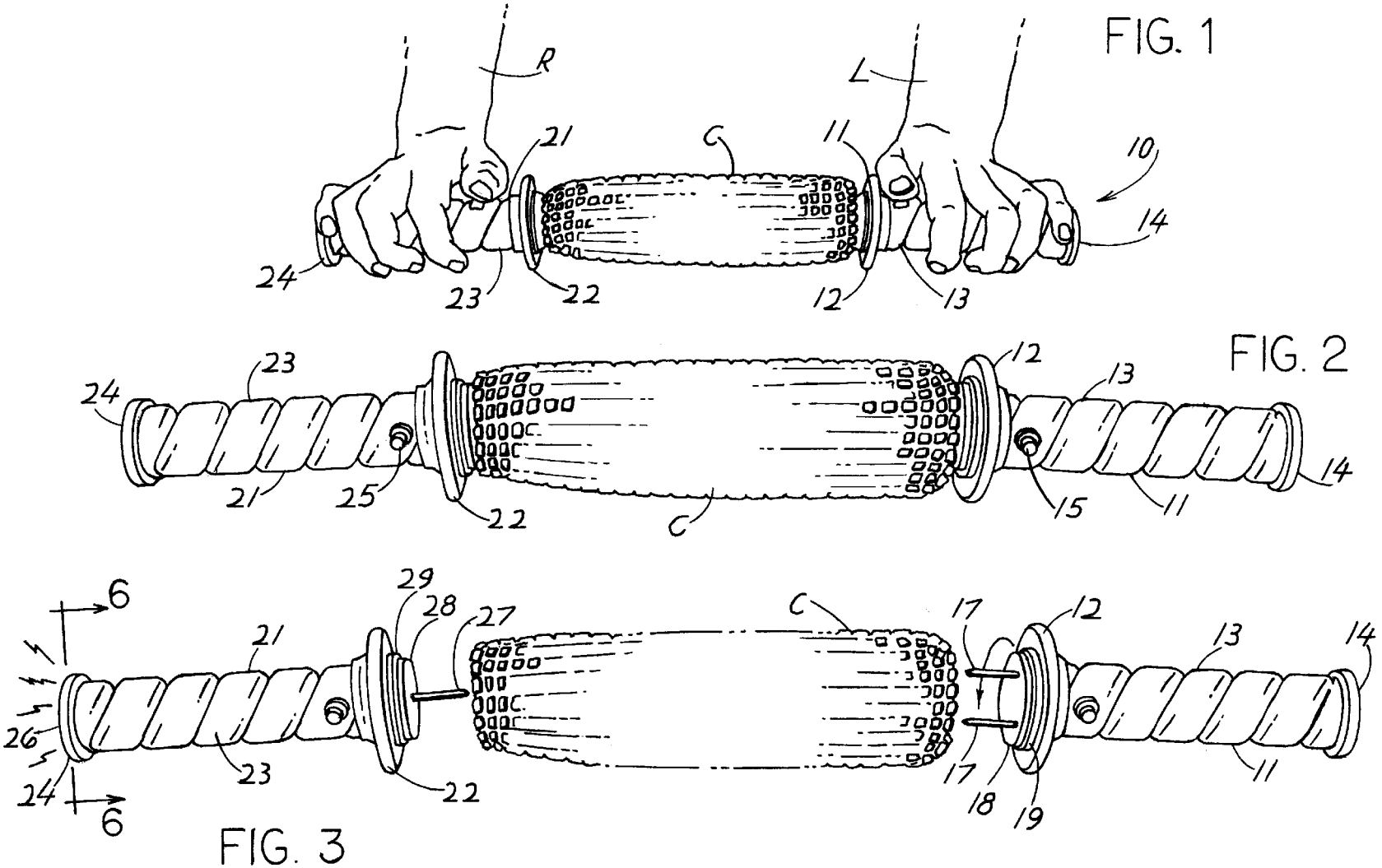
FIG. 1 is a front perspective view of the corn cob holding device constructed in accordance with the present invention as it is intended to be held by a user of the device.
FIG. 2 is an enlarged front perspective view of the holding device shown in FIG. 1 as it is used with a cob of corn.
FIG. 3 is an exploded front perspective view of the holding device shown in FIG. 2.

Referring now to the drawings in detail, FIG. 1 shows the holding device of the present invention, generally identified 10, as used with a typical cob of corn C. As shown, a pair of handle members 11, 21 are positioned to either side of the cob C and held in tandem by the user in his or her left and right hands L, R, respectively. Although shown in this orientation, it is to be understood that the handle members 11, 21 could be used equally well even if the user reversed them. The first handle member 11 includes a central grip portion 13 which extends between an inwardly located end flange 12 and an outwardly located end flange 14. Similarly, the second handle member 21 includes a central grip portion 23 which extends between an inwardly located end flange 22 and an outwardly located end flange 24. It is the grip portions 13, 23 which are intended to be grasped by the user. In the preferred embodiment, the grip portions 13, 23 simulate the handle bar wraps of a type commonly found on motorcycle handle bars. The first handle member 11 has an activation button 15 built into the grip portion 13. See FIG.

2. Though not shown, it is to be understood that the first handle member 11 contains an internal cavity which houses a battery or other power supply source and a drive mechanism. The drive mechanism comprises a direct current motor and a screw type drive or other suitable gear ratio reducing mechanism. Although not shown in the preferred embodiment, it is to be understood that the activation button 15 could also comprise a directional switch by which both speed and direction of the rotation of the cob of corn C could be controlled by the user. In the preferred embodiment, a drive square 1 extends from the outward face of the inwardly located flange 12. See FIG. 4. This drive square 1 is connected directly to and is driven by the drive mechanism contained within the first handle member 11. In the experience of this inventor, the gear ratio is an important factor insofar as it controls the speed and amount of rotation of the drive square 1. It is also to be understood that any number of design alternatives exist for this drive square 1 and still come within the intended function of the present invention.

Removably attachable to the drive square 1 of the first handle member 11 is a spike assembly which includes a first spike flange 18, a second spike flange 19 and a pair of spikes 17. See FIG. 5. In the preferred embodiment, the spikes 17 are made of a stainless steel material and extend through the first spike flange 18. The first spike flange 18 and the second spike flange 19 are made of a dishwashersafe plastic material and are fastened together with a glue or other bonding agent. This allows for proper cleaning of the spike assembly after it is used. The second spike flange 19 includes a drive square recess 2 which is functionally adapted to receive and be driven by the drive square 1 as previously described. See FIG. 4.

In the preferred embodiment, the grip portion 23 of the second handle member 21 has an activation button 25 built into it. Though not shown, it is to be understood that the second handle member 21 contains an internal cavity which houses a battery or other power supply source and a sound generating device. The sound generating device comprises an integrated circuit sound card and a speaker 26. The speaker 26 is located in the outwardly located flange 24 of the second handle member 21. See FIGS. 3 and 6.

Removably attachable to the second handle member 21 is a spike assembly which includes a first spike flange 28, a second spike flange 29 and a single spike 27. See FIG. 3. In the preferred embodiment, the spike 27 is also made of a stainless steel material and extends through the first spike flange 28. The first spike flange 28 and the second spike flange 29 are also made of a dishwasher-safe plastic material and are fastened together with a glue or other bonding agent. This allows for proper cleaning of the spike assembly after it is used. The spike 27 of this assembly simply allows one end of the corn cob C to rotate about it.

In application, the user skewers a cob of corn C between the first and second handle members 11, 21. The activation button 15 of the first handle member 11 is depressed to initiate and sustain cob C rotation as such is desired or required. As this rotation is ongoing, the activation button 25 of the second handle member 21 is depressed to generate a motorcycle-like sound which emanates from the speaker 26. When the cob C is fully consumed, the spike and flange assembly 17, 18, 19 of the first handle member 11 and the spike and flange assembly 27, 28, 29 of the second handle member 21 are removed and cleaned for re-use. The device 10 can be used over and over again.

From the foregoing detailed description of the preferred embodiment of the invention set forth herein, it will be apparent that there has been provided a new, useful and uncomplicated corn cob holding device which is easily used by youngsters of all ages; which is electrically actuable so as to allow rotation of the corn cob without the need to manually do so; which is easily cleanable and reusable; which includes a sound generating device; and which is fun to use.

The principles of this invention having been fully explained in connection with the foregoing, I hereby claim as my invention:

1. A device for holding a cob of corn, said cob of corn having a first end and a second end, which comprises a longitudinally extending first handle member, said first handle member having a first end and a second end, a first corn cob skewer, said first corn cob skewer being removably attachable to the first end of said first handle member and further being functionally adapted to skewer a first end of said cob of corn, a direct current power supply contained within said first handle member, a direct current motor contained within said first handle member, a drive mechanism contained within said first handle member for rotating said first corn cob skewer when direct current is applied to said motor, means for actuating the rotation of the first skewer by the supply of direct current to said motor whereby rotation of the first skewer is effected, a longitudinally extending second handle member, said second handle member having a first end and a second end, a second corn cob skewer, said second corn cob skewer being removably attachable to the first end of said second handle member and freely rotatable about said second handle member and further being functionally adapted to skewer the second end of said cob of corn whereby said cob of corn rotates between said first and second handle members when rotation of said first skewer is effected.

2. The corn cob holding device of claim 1 including a direct current power supply contained within said second handle member, a direct current sound generating device contained within said second handle member and means for actuating the supply of direct current to said sound generating device whereby a sound emanates from said second handle member upon actuation of the direct current supply contained within said second handle member.

3. The corn cob holding device of claim 2 wherein said sound generating device generates a sound which simulates the noise of a motorcycle engine.

4. The corn cob holding device of claim 3 wherein said first handle member skewering means comprises a first attachable plate having a pair of prongs extending generally perpendicularly from said first plate and away from said first handle member and said second handle member skewering means comprises a second attachable plate having a pair of prongs extending generally perpendicularly from said second handle member.

5. The corn cob holding device of claim 4 wherein the rotation actuation means contained within said first handle member further includes means for controlling the speed of rotation of the first corn cob skewer.

6. A device for holding a cob of corn which comprises a first handle member, a first handle member corn cob skewering means, said first handle member corn cob skewering means being attachable to said first handle member, a second handle member, a second handle member corn cob skewering means, said second handle member corn cob skewering means being attachable to said second handle member and, and means for electrically actuating rotation of the first handle member skewering means whereby a corn cob held at one end by said first handle member skewering means and at its other end by said second handle member skewering means is rotated therebetween.

7. The corn cob holding device of claim 6 wherein said first handle member skewering means comprises an attachable plate having a pair of prongs extending from said plate and away from said first handle member.

8. The corn cob holding device of claim 7 wherein said second handle member skewering means comprises an attachable plate having a single prong extending from said plate and away from said second handle member.

9. The corn cob holding device of claim 8 wherein said rotation actuating means includes means for controlling the speed of rotation of the corn cob.

10. The corn cob holding device of claim 9 wherein said second handle member includes an electrically actuated sound generating device.

11. The corn cob holding device of claim 10 wherein said sound generating device generates a sound which simulates the noise of a motorcycle engine.

12. A corn cob holding device which comprises a first handle member, said first handle member being formed in the shape of a motorcycle handlebar grip, a second handle member, said second handle member being formed in the shape of a motorcycle handlebar grip, said first and second handle members being configured to be used in tandem with said first handle member being functionally adapted to be held in a user's hand and said second handle member being functionally adapted to be held in the user's other hand, a first handle member corn cob skewering means, said first handle member corn cob skewering means being attached to said first handle member, a second handle member corn cob skewering means, said second handle member corn cob skewering means attached to said second hand member, and means for electrically actuating rotation of the first handle member skewering means whereby a corn cob held between said first handle member skewering means and said second handle member skewering means is rotated.

13. The corn cob holding device of claim 12 wherein said first handle member skewering means comprises an attachable plate having a pair of prongs extending from said plate and away from said first handle member.

14. The corn cob holding device of claim 13 wherein said second handle member skewering means comprises an attachable plate having a single prong extending from said plate and away from said second handle member.

15. The corn cob holding device of claim 14 wherein said rotation actuating means includes means for controlling the speed of rotation of the corn cob.

16. The corn cob holding device of claim 15 wherein said second handle member includes an electrically actuated sound generating device.

17. The corn cob holding device of claim 16 wherein said sound generating device generates a sound which simulates the noise of a motorcycle engine.

* * * * *